US005337764A

United States Patent [19]

McKay

[11] Patent Number: 5,337,764

[45] Date of Patent: Aug. 16, 1994

[54] FLUID DISPENSING COMB

[76] Inventor: William D. McKay, 528 Kelso St., Flint, Mich. 48506

[21] Appl. No.: 936,036

[22] Filed: Aug. 25, 1992

Related U.S. Application Data

[63] Continuation-in-part of Ser. No. 917,854.

[51] Int. Cl.[5] ..... A45D 24/22

[52] U.S. Cl. ..... 132/116; 132/112; 132/114

[58] Field of Search ..... 132/108, 112, 113, 114, 132/115, 116, 150, 110, 111

[56] References Cited

U.S. PATENT DOCUMENTS

| | | | |
|---|---|---|---|
| 85,311 | 12/1868 | Kerr, Jr. et al. | 132/113 |
| 792,124 | 6/1905 | Evans | 132/114 |
| 1,059,282 | 4/1913 | De Bassini . | |
| 1,408,262 | 2/1922 | Brueck et al. . | |
| 1,449,096 | 3/1923 | Grieten | 132/114 |
| 1,487,374 | 3/1924 | De Bassini | 132/108 |
| 1,615,581 | 1/1927 | Harris | 401/134 |
| 1,823,850 | 5/1930 | Marshall . | |
| 1,829,021 | 10/1931 | Sinclair | 132/113 |
| 1,876,033 | 9/1932 | Starr | 132/113 |
| 2,101,132 | 12/1937 | Daly et al. | 132/112 |
| 2,108,184 | 2/1938 | Wallenius | 132/116 |
| 2,148,966 | 3/1938 | Schmidt . | |
| 2,594,721 | 4/1952 | Beebe | 132/116 |
| 2,596,296 | 5/1952 | Shields . | |
| 2,608,976 | 9/1952 | Kittle et al. | 132/150 |
| 2,609,821 | 9/1952 | Weissberger | 132/116 |
| 2,737,190 | 3/1956 | Magnusson . | |
| 2,794,443 | 6/1957 | Moore | 132/113 |
| 3,147,757 | 9/1964 | Hofmann | 132/114 |
| 3,295,537 | 1/1967 | Young, Jr. | 132/113 |
| 3,429,642 | 2/1969 | Underwood | 132/116 |
| 3,446,216 | 5/1969 | Sala . | |
| 3,456,658 | 7/1969 | Long, Jr. . | |
| 3,463,170 | 8/1969 | McCullough | 132/113 |
| 3,520,311 | 7/1970 | Iesersek et al. | 132/116 |
| 3,683,942 | 8/1972 | McKay . | |
| 3,818,917 | 6/1974 | Hudson | 132/116 |
| 3,908,679 | 9/1975 | Wright | 132/116 |
| 4,090,522 | 5/1978 | Donley et al. | 132/112 |
| 4,317,464 | 3/1982 | Bailey et al. | 132/113 |
| 4,585,018 | 3/1984 | O'Connor . | |
| 4,747,430 | 5/1988 | Alaimo . | |
| 4,792,250 | 12/1988 | Turner | 132/112 |

FOREIGN PATENT DOCUMENTS

| | | | |
|---|---|---|---|
| 7460 | of 1907 | United Kingdom | 132/114 |
| 299732 | 10/1928 | United Kingdom | 132/108 |

*Primary Examiner*—Gene Mancene
*Assistant Examiner*—Frank A. LaViola
*Attorney, Agent, or Firm*—Stetina and Brunda

[57] ABSTRACT

A dispensing comb for applying a fluid to the hair has a body with a plurality of teeth formed thereon and at least one, preferably two, fluid reservoirs removably attached to the body such that fluid communication is provided from the reservoirs to the teeth. The two reservoirs have thin seals which rupture when the two reservoirs are interconnected such that two different fluids contained therein intermix. Attachment of the two reservoirs to the comb body similarly causes the puncture of a seal to facilitate fluid communication of the mixed components through the comb to the teeth thereof. In a first embodiment, a pin disposed upon the first reservoir punctures a seal in the second reservoir and two fluids then intermix via a bore in the pin. A similar pin, disposed upon the body, punctures a similar seal in the first reservoir to effect fluid communication from of the mixture from the two reservoirs to the teeth of the comb. In a second embodiment, a serrated annular knife simultaneously cuts through the seals of both reservoirs, thus causing their contents to intermix. A pin, having a bore formed therethrough, facilitates fluid communication from the two reservoirs to the teeth of the comb as in the first embodiment. As such, the dispensing comb of the present invention facilitates the easy and convenient application of two-component hair conditioning mixtures to the user's hair. The need to individually open separate containers, mix the contents thereof in a third container, and disperse the mixture throughout the hair with the hands, is thereby eliminated.

5 Claims, 2 Drawing Sheets

Fig. 6
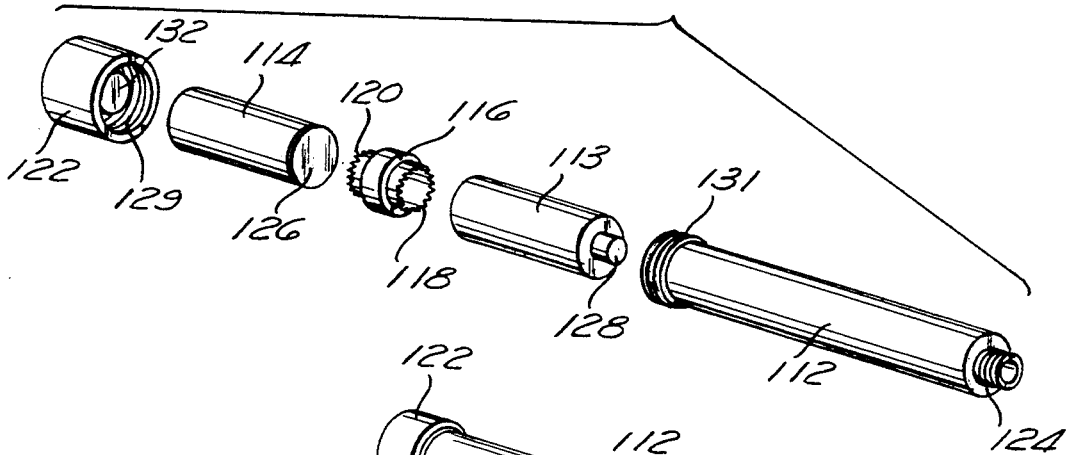
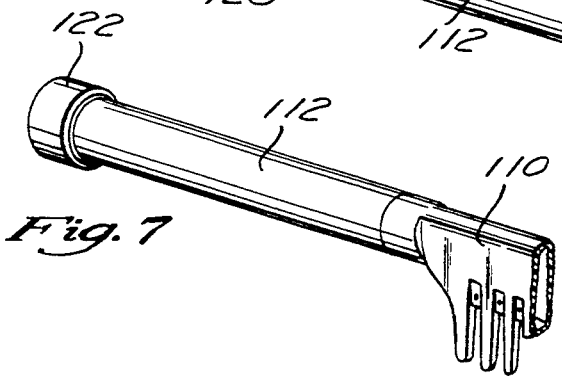
Fig. 7
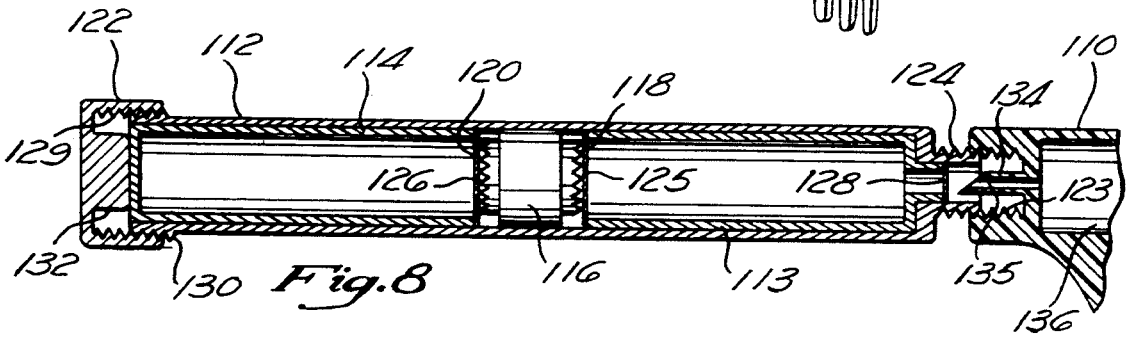
Fig. 8
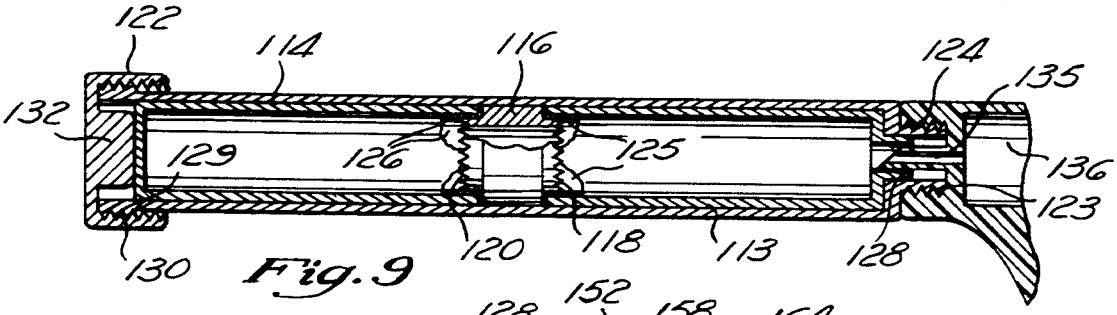
Fig. 9
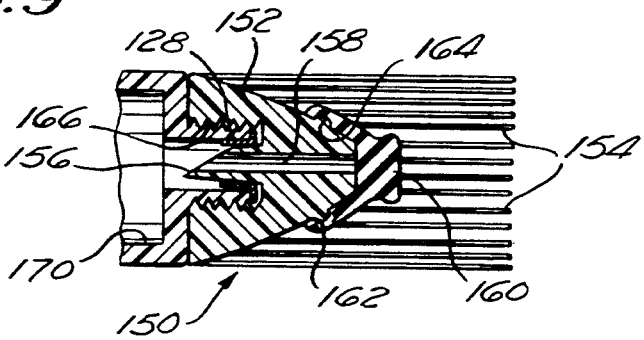
Fig. 10

FLUID DISPENSING COMB

RELATED APPLICATIONS

The subject application is a continuation-in-part of U.S. Ser. number 07/917,854, pending filed Jul. 17, 1992, and entitled FLUID DISPENSING COMB, the contents of which are hereby incorporated by reference.

FIELD OF THE INVENTION

The present invention relates generally to combs and more particularly to a fluid dispensing comb having at least one detachable reservoir for storing and dispensing hair oil, conditioner, coloring, lightener, highlight, gloss, detangler, or the like directly upon a user's hair. Multiple reservoirs may be utilized to effect mixing of two or more component mixtures.

BACKGROUND OF THE INVENTION

Combs used for styling and grooming of the hair are well known. Such combs typically comprise a linear array of teeth which may be raked through the hair so as to position the hair in a desired manner. Various styles and configurations of combs are known.

Additionally, it is well known to apply various fluids, i.e., hair oil, conditioner, hair coloring, lightener, highlight, gloss, detangler, and the like, to the hair to promote its health and improve its appearance. Such fluids are typically applied by being dispensed from their container onto one's hair and then being manually dispersed through the hair with one's hands. Such manual dispersion of the fluid through one's hair inherently possesses substantial disadvantages. For instance, it generally requires that the user's hands come into intimate contact with the fluid. This is particularly undesirable in many instances wherein the fluid being dispersed may discolor or otherwise have an undesirable effect upon the skin and/or fingernails of the user's hands.

Furthermore, once a user's hands have come into contact with such a fluid, it is extremely difficult to avoid transferring the fluid to the user's clothing and/or other nearby objects. This is due to the frequency and habitual nature of utilizing one's hands in the performance of essentially all manual tasks.

For example, one may reach into one's pocket prior to remembering that one's hands have contacted the fluid, thus soiling one's clothing. This is particularly crucial in those instances where a fluid such as hair coloring is being applied to one's hair and has come into contact with one's hands. Such hair colorings may potentially discolor or stain clothing, towels, or other items or fabrics with which they come into contact.

The application of two-component hair treatment mixtures to the hair is common. Two-component mixtures such as bleaches, hair colorings, permanents, and conditioners, lighteners, highlight, gloss, and detangler are commonly applied to the hair by first pouring the two components from their separate containers into a common container. The two components are then shaken, stirred, or otherwise caused to mix together such that a two-component mixture is formed thereby. The two-component mixture is then dispersed throughout the hair, generally by pouring a small portion of the two-component mixture into the hair and spreading the mixture throughout the hair with the hands. Gloves are typically required to limit contact with the skin since the chemicals utilized in such mixtures often cause burning, itching, or other undesirable sensations and/or cause discoloration of the skin. As such, use of the hands to manually spread or disperse the mixture throughout the hair is highly undesirable.

Thus, it is desirable to provide a means for easily and conveniently effecting the combining of the components of such two-component mixtures and for dispersing the resulting two-component mixtures throughout the hair in an effective and efficient manner without requiring use of the hands.

SUMMARY OF THE INVENTION

The present invention specifically addresses and alleviates the above mentioned deficiencies associated in the prior art. More particularly, the present invention comprises a dispensing comb for applying a fluid to the hair. The dispensing comb has a body with a plurality of teeth formed thereon and at least one, preferably two or more, fluid reservoirs removably attached to the body such that fluid communication is provided from the reservoirs to the teeth.

The two reservoirs preferably have seals which rupture when the two reservoirs are interconnected such that two different fluids contained therein intermix. Attachment of the two reservoirs to the comb body preferably similarly causes the puncture of another seal to facilitate fluid communication of the mixed components through the comb to the teeth thereof such that the two-component hair treatment mixture may thereby be conveniently applied to the hair.

In a first embodiment, a pin disposed upon a first reservoir punctures a seal in a second reservoir and two fluids then intermix via a bore in the pin. A similar pin, disposed upon the comb body, punctures a similar seal in the first reservoir to effect fluid communication of the mixture from the two reservoirs to the teeth of the comb. An absorbent pad may optionally be disposed within the teeth and/or body of the comb to facilitate delivery of the fluid to the user's hair.

In a second embodiment, a serrated annular knife simultaneously cuts through the seals of both reservoirs contained within a common bore of the comb's handle, thus causing their contents to intermix. A pin, having a bore formed therethrough, then facilitates fluid communication from the two reservoirs to the teeth of the comb as in the first embodiment. As in the first embodiment, an absorbent pad may optionally be disposed within the teeth and/or body of the comb to facilitate delivery of the fluid to the user's hair.

As such, the dispensing comb of the present invention facilitates the easy and convenient application of two-component hair conditioning mixtures to the user's hair. The need to individually open separate containers, mix the contents thereof in a third container, and disperse the mixture throughout the hair with the hands, is thereby eliminated.

These, as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 6 is an exploded perspective view of a second embodiment of the fluid dispensing comb of the present invention illustrating two fluid cartridges to be disposed within the handle of the comb and also illustrating a serrated annular knife for effecting intermixing of the fluid components contained therein;

FIG. 7 is a perspective view of the handle of the fluid dispensing comb of FIG. 6;

FIG. 8 is a cross-sectional side view of the handle containing the two fluid cartridges of FIG. 6 prior to attachment thereof to the comb body and prior to cutting of cartridge seals with the serrated annular knife;

FIG. 9 is a cross-sectional side view of the handle and comb body of FIG. 8 subsequent to the attachment of the handle to the comb body and subsequent to cutting of the cartridge seals with the serrated knife; and FIG. 10 is a cross-sectional side view of an alternative dispensing means attached to the handle.

DETAILED DESCRIPTION OF THE PREFERRED EMBODIMENT

The detailed description set forth below in connection with the appended drawings is intended as a description of the presently preferred embodiments of the invention and is not intended to represent the only forms in which the present invention may be constructed or utilized, The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
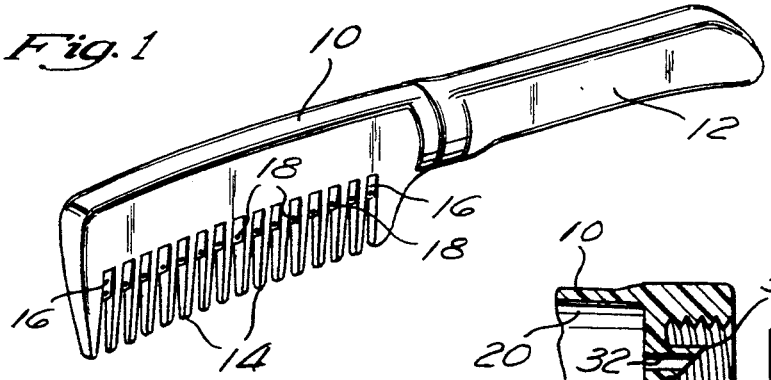
FIG. 1 is a perspective view of a first embodiment of the fluid dispensing comb of the present invention.
Figure 2:
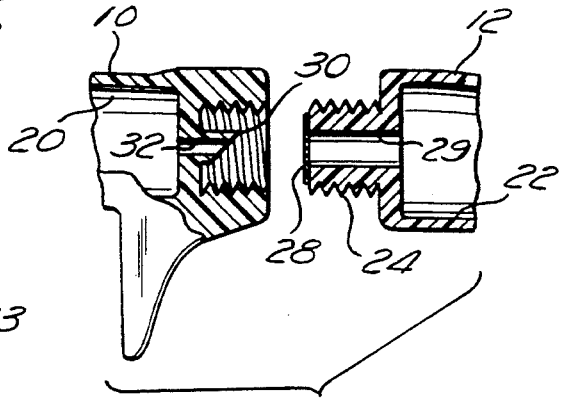
FIG. 2 is an enlarged sectional view, partially in cross-section, of the male and female threaded couplings interconnecting the body and handle of the fluid dispensing comb of FIG. 1.

The fluid dispensing comb of the present invention is illustrated in FIGS. 1–10 which depict two presently preferred embodiments of the invention. Referring now to FIGS. 1 and 2, the fluid dispensing comb is generally comprised of a comb body 10 detachably attached to a handle 12 and having a plurality of teeth 14 extending therefrom. A fluid dispensing conduit 16 extends through at least a portion of the comb body 10 proximate the teeth 14 and has a plurality of fluid dispensing apertures 18 formed therein such that the fluid contained within the fluid dispensing conduit 16 may readily pass therethrough and onto the teeth 14 and the user's hair. As an alternative to passing onto the user's hair via the teeth 14, the fluid contained within the fluid dispensing conduit 16 may be transferred directly to the user's hair from the fluid dispensing apertures 18 or from a wiping blade formed as part of the comb body 10. Additionally, if the comb body 10 is formed to include a wiping blade, apertures similar to the fluid dispensing apertures 18 may be disposed in the bottom of the wiping blade to facilitate the transfer of the fluid from the fluid dispensing conduit 16 to the user's hair. An absorbent pad (not shown) may optionally be disposed within at least a portion of the teeth 14 and/or the comb body 10 to facilitate flow of the fluid to the user's hair.

With particular reference to FIG. 2, the handle 12 attaches to the comb body 10 via a threaded male coupling member 24 formed upon the handle 12 and a complimentary threaded female coupling member 26 formed upon the comb body 10. A bore 29 is formed within the threaded male coupling member and a corresponding bore 32 formed within a needle 30 of the threaded female coupling member 26 provides fluid communication from a reservoir 22 formed within the handle 12 to a bore 20 formed within the fluid dispensing conduit 16. The handle 12 may optionally be comprised of flexible material such that squeezing the handle 12 causes fluid to flow from the reservoir 22.

A seal 28, preferably a thin membrane or foil, covers and closes the bore 29 such that fluid contained within the reservoir 22 remains therein until the seal 28 is punctured by the needle 30.

Figure 5:
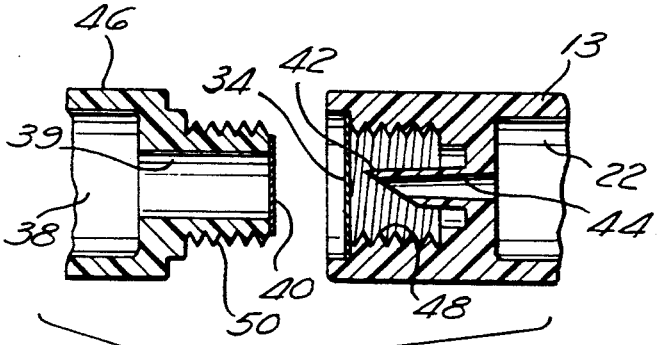
FIG. 5 is an exploded cross-sectional view of the interconnection means of the two reservoirs of FIG. 3.
Figure 3:
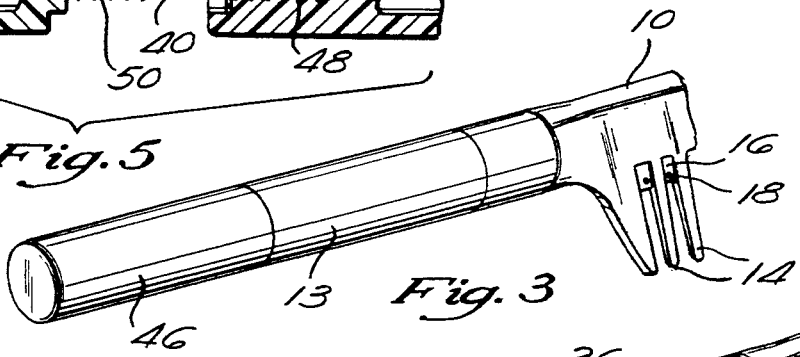
FIG. 3 is a perspective view of an alternative configuration of the first embodiment of the fluid dispensing comb of the present invention wherein the handle comprises two separate reservoirs which facilitate the intermixing of the two components of a two-component hair treatment mixture.
Figure 4:
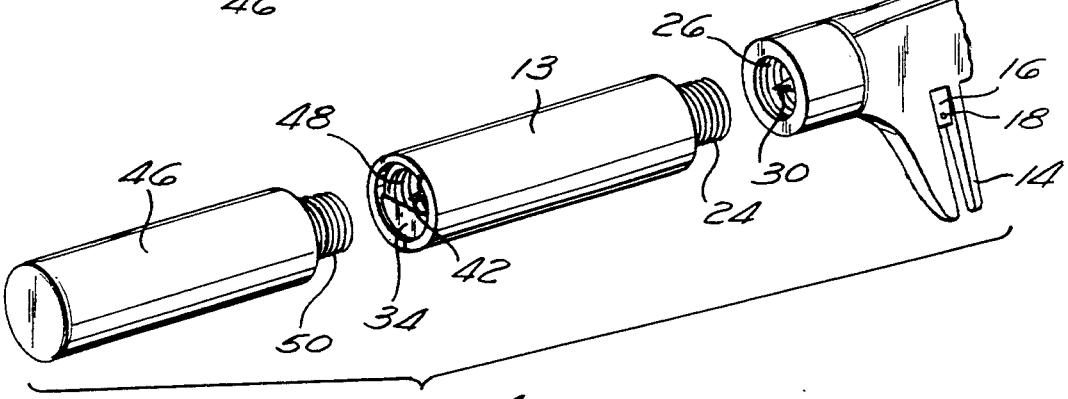
FIG. 4 is an exploded perspective of the two reservoirs and the comb body attachment means of FIG. 3.

Referring now to FIGS. 3–5, in an alternative configuration of the first embodiment of the fluid dispensing comb of the present invention, a plurality, preferably two, of fluid reservoirs form the handle of the comb body 10 such that mixing of a two-component mixture may be achieved thereby and dispensed through the comb body 10 to a user's hair. A first reservoir 13 attaches directly to the comb body 10 in the manner illustrated and discussed in conjunction with FIG. 2. A second reservoir 46 attaches to the first reservoir in a similar manner.

With particular reference to FIG. 5, the second handle portion 46 has a reservoir 38 formed therein and a bore 39 extending through a threaded male coupling member 50 formed thereon. A seal 40 closes the bore 39. A similar seal 34 seals fluid within the first reservoir 22 of the first handle section 13. A needle 42 having a bore 44 formed therein punctures the seal 40 of the second reservoir 38 and the threaded male coupling 50 punctures the seal 34 when the threaded male coupling 50 is urged into the complimentary threaded female coupling 48.

Having described the structure of the first embodiment of the fluid dispensing comb of the present invention, it may be beneficial to describe the operation thereof. For the single reservoir configuration, as illustrated in FIG. 1, a handle 12 having a reservoir 22 formed therein containing a desired fluid, i.e. hair oil, conditioner, hair coloring, lightener, highlight, gloss, detangler, or the like, is attached to the comb body 10 by inserting the threaded male coupling 24 of the handle 12 into the complimentary threaded female coupling 26 of the comb body 10 and screwing the two coupling members 24 and 26 together.

Attachment of the handle 12 to the comb body 10 causes the seal 28 to be punctured by the needle 30 as the two coupling members 24 and 26 are screwed together. Such attachment results in fluid communication from the fluid reservoir 22 through the bore 29 of the male coupling member 24 and through the bore 32 of the needle 30 into the bore 20 of the fluid dispensing conduit 16 from which the fluid is dispensed through the apertures 18 onto the teeth of the comb 14 and then onto the user's hair. As previously specified, the fluid may also be dispensed through the apertures 18 onto a wiping blade formed as part of the comb body 10 or directly from the apertures 18 onto the user's hair. Additionally, if the comb body 10 is formed to include a wiping blade, apertures similar to the apertures 18 may be disposed in the bottom thereof to dispense the fluid from the fluid dispensing conduit 16 onto the user's hair. A portion of the fluid may be dispensed directly from the fluid dispensing apertures 18 onto the user's hair. Thus, dispensing of the fluid takes place without the need for having the fluid come into contact with the user's hands.

Referring now to FIGS. 6–9, a second embodiment of the fluid dispensing comb of the present invention is illustrated. In the second embodiment, a single handle 112 connects to the comb body 110 in a manner similar to that of the first embodiment thereof. A threaded male coupling member 124 is received by a complimentary threaded female coupling member 123. A needle 134 having a bore 135 extends from the comb body 110 within the female coupling member 123 and punctures a first seal 128 during the coupling process as in the first embodiment. It will be recognized that the needle 134 may be formed to have any alternative configuration which is suitable to puncture the first seal 128 during the coupling process.

The hollow handle 112 receives a first fluid cartridge 113, a serrated annular knife 116, and a second fluid cartridge 114. A cap 122 having female threads 129 formed therein receives complimentary threads 130 formed upon the proximal end of the handle 112, thus sealing the first 113 and second 114 fluid cartridges within the handle 112.

A second seal 125 formed upon the proximal end of the first cartridge 113 contacts first serrated knife edge 118 of the serrated annular knife 116 and a similar third seal 126 formed upon the distal end of second fluid cartridge 114 likewise contacts a similar serrated knife edge 120 formed upon the same serrated annular knife 116.

Having described the structure of the second embodiment of the fluid dispensing comb of the present invention, it may be beneficial to describe the operation thereof. First 113 and second 114 fluid cartridges containing desired fluids, such as hair oil, conditioner, hair coloring, lightener, highlight, gloss, and/or detangler are inserted into the handle 112 with the serrated annular knife 116 positioned intermediate the first 113 and second 114 fluid cartridges. Tightening of the cap 132 upon the handle 112 causes the second cartridge 114 to be urged toward the first cartridge 113 as the female threads 129 of the cap 122 draw the cap 122 distally upon the complimentary male threads 130 of the handle 112.

As the second cartridge 114 is urged toward the first cartridge 113, the first serrated knife edge 118 cuts or effects opening of the second seal 125 of the first cartridge 113 and the second serrated knife edge 120 similarly effects opening of the seal 126 of the second cartridge 114. Thus, fluid intercommunication of the first 113 and second 114 cartridges is obtained and intermixing of the two components contained therein is achieved.

The fluid dispensing comb of the second embodiment of the present invention may be shaken moderately to enhance mixing of the two fluid components therein. Attachment of the handle 112 to the comb body 110 effects fluid communication from the two components contained within the handle 112 to the bore 136 of the comb body 110 via bore 135 of needle 134 as in the first embodiment.

Referring now to FIG. 10, an alternative arrangement of the fluid dispensing means is illustrated. In this alternative arrangement an applicator tip cap assembly 150 is screwed directly onto the male coupling member 124 via female coupling member 166. The cap assembly 150 comprises a needle 156 having a bore 158 formed therethrough and a cover 160 formed upon the distalmost portion thereof. Male detent 162 formed upon the cap 152 and complimentary female detent 164 formed upon the cover 160 facilitate secure attachment thereof. The cover 160 fits loosely upon the cap 152 such that fluid may flow intermediate the cap 152 and cover 160. Bristles 154 are formed upon the cap 152.

Having described the structure of the alternative arrangement of the second embodiment of the fluid dispensing comb of the present invention, a description of the operation thereof may be beneficial. Utilizing either the single reservoir configuration of FIGS. 1 and 2 or the double reservoir configuration of FIGS. 3 and 4 or FIGS. 6–9, the cap 152 of FIG. 10 is substituted for the comb body 110.

As the female coupling member 166 of the cap 152 is threaded onto the male coupling member 124, the needle 156 effects puncturing of the seal 128 thereof. This places the bore 158 of the cap 152 in fluid communication with the reservoir 170 such that fluid may pass through the bore 158 and intermediate the cap 152 and the cover 160 from which it may be dispensed onto the bristles 154 and distributed throughout the hair. This alternative configuration of the second embodiment of the present invention is particularly useful for spot retouching of the hair, i.e. highlighting and spot bleaching.

It is understood that the exemplary dispensing comb described herein and shown in the drawings represents only presently preferred embodiments of the invention. Indeed, various modifications and additions may be made to such embodiments without departing from the spirit and scope of the invention. For example, the dispensing comb need not be limited to two reservoirs, but rather any desired number of reservoirs may similarly be utilized. Such multiple reservoir combs may be utilized in conjunction with three or more component mixtures. Additionally, various means other than the needle and serrated annular knife, i.e. hollow needles, are contemplated for effecting fluid communication of the two reservoirs. Any of the reservoirs, cartridges, and/or handles of any embodiment of the present invention may optionally be comprised of a resilient or flexible material such that fluid may be squeezed therefrom. Furthermore, it is recognized that various other means are equivalent to the use of threads, illustrated and described for interconnecting the various components of the present invention. Thus, these and other modifications and additions may be obvious to those skilled in the art may be implemented to adapt the present invention for use in a variety of different applications.

What is claimed is:

1. A fluid dispensing comb for applying fluid to a user's hair, said fluid dispensing comb comprising:

(a) a body having a plurality of teeth formed thereon;

(b) first and second fluid reservoirs removably attachable to said body such that fluid communication is provided from said reservoirs to said teeth, said first reservoir having a first seal formed thereon and said second reservoir having a second seal formed thereon;

(c) a first seal breaking means disposed upon said body;

(d) a second seal breaking means disposed upon said first reservoir;

(e) wherein said first reservoir is screwably attachable to said body such that attaching said first reservoir to said body causes said first seal breaking means to break the first seal on said first reservoir to provide fluid communication from said first reservoir to said teeth; and (f) wherein said second reservoir s screwably attachable to said first reservoir such that attaching said second reservoir to said first reservoir causes said second seal breaking means to break the second seal on said second reservoir to provide fluid communication from said second reservoir to said teeth.

2. A fluid dispensing comb for applying fluid to a user's hair, said fluid dispensing comb comprising:

(a) a body having a plurality of teeth formed thereon;

(b) first and second fluid reservoirs removably attached to said body such that fluid communication is provided from said fluid reservoirs to said teeth, said second reservoir being disposable proximate said first reservoir and attached thereto;

(c) a first seal disposed upon said first reservoir;

(d) a first seal breaking mean disposed upon said body;

(e) a second seal formed upon said first reservoir;

(f) a third seal formed upon sad second reservoir for sealing fluid within said second reservoir;

(g) a seal breaking means disposed intermediate said first and second reservoirs for breaking said second and third seals; and (h) wherein said first reservoir is screwably attachable to said body such that attaching said first reservoir to said body causes said first seal breaking means to break a first seal on said first reservoir to provide fluid communication from said first reservoir to said teeth.

3. A fluid dispensing comb for applying fluid to a user's hair, said fluid dispensing comb comprising:

(a) a body having a plurality of teeth formed thereon;

(b) a plurality of reservoirs defining a handle and in fluid communication with on another such that a plurality of fluids are mixed, said plurality of reservoirs being removably attachable to said body such that fluid communication is provided from said plurality of reservoirs to said teeth; and (c) a seal formed upon said handle and sealing said plurality of fluids within said plurality o reservoirs, said seal being broken by attachment of said plurality of reservoirs to said body to provide fluid communication from said plurality of reservoirs to said teeth such that said plurality of fluids are applied to the hair.

4. A fluid dispensing comb for applying fluid to a user's hair, said fluid dispensing comb comprising:

(a) a body having a plurality of teeth formed thereon, said body having a first seal breaking means disposed thereon;

(b) a first and second reservoirs defining a handle;

(c) said first reservoir being screwably attachable to said body such that attaching said first reservoir to said body causes said first seal breaking means to break a first seal on said first reservoir to provide fluid communication from said first reservoir to said teeth;

(d) a second seal breaking means being disposed upon said first reservoir; and (e) said second reservoir being screwably attachable to said first reservoir such that attaching said second reservoir to said first reservoir causes said second seal breaking means to break a seal on said second reservoir to provide fluid communication from said second reservoir to said teeth.

5. A fluid dispensing comb for applying fluid to a user's hair, said fluid dispensing comb comprising:

(a) a body having a plurality of teeth formed therein, said body having a first seal breaking means disposed thereon;

(b) a first and second reservoirs defining a handle;

(c) said first reservoir having a first seal disposed thereon, said first reservoir being screwably attachable to said body such that attaching said first reservoir to said body causes said first seal breaking means to break said first seal on said first reservoir to provide fluid communication from said first reservoir to said teeth;

(d) a second seal being formed upon said first reservoir;

(e) said second reservoir being disposable proximate said first reservoir and attachable thereto;

(f) a third seal being formed upon said second reservoir for sealing fluid within said second reservoir; and (g) a seal breaking means being disposed intermediate said first ad second reservoirs for breaking said second and third seals.

* * * * *